United States Patent [19]

Schober et al.

[11] 3,993,490

[45] Nov. 23, 1976

[54] DIRECT POSITIVE PHOTOGRAPHIC ELEMENTS CONTAINING DEVELOPERS

[75] Inventors: Manfred Schober, Offenbach, Main; Wolfgang A. Augstein, Urberach, both of Germany

[73] Assignee: E. I. Du Pont de Nemours and Company, Wilmington, Del.

[22] Filed: Feb. 6, 1975

[21] Appl. No.: 547,749

[30] Foreign Application Priority Data

Feb. 12, 1974 Germany ..... 2406515

[52] U.S. Cl. ..... 96/95; 96/64

[51] Int. Cl.[2] ..... G03C 1/06; G03C 5/24

[58] Field of Search ..... 96/66 R, 64, 66.3, 66 HD, 96/95

[56] References Cited

UNITED STATES PATENTS

| | | | |
|---|---|---|---|
| 2,675,318 | 4/1958 | Russell et al. | 96/64 |
| 3,615,517 | 10/1971 | Milton et al. | 96/64 |
| 3,632,340 | 1/1972 | Illingsworth | 96/64 |
| 3,690,891 | 9/1972 | Spence | 96/64 |
| 3,733,198 | 5/1973 | Vanreusel et al. | 96/64 |
| 3,816,135 | 6/1973 | Hunt | 96/64 |

OTHER PUBLICATIONS

Axford, "Exhaustion of Phenidone Developers by Aeration, and the Superadditivity of Phenidone C HQ Monosulphonate," 1959, Journal of Photographic Science, vol. 7, pp. 120–125.

*Primary Examiner*—Mary F. Kelley

[57] ABSTRACT

Direct positive film with incorporated developer having improved sensitometric properties and storage stability is obtained with a developer combination of hydroquinone monosulfonate and a superadditive developer of the 3-pyrazolidone or the N-methyl-p-aminophenol sulfate types.

7 Claims, No Drawings

DIRECT POSITIVE PHOTOGRAPHIC ELEMENTS CONTAINING DEVELOPERS

FIELD OF THE INVENTION

The invention relates to direct positive photographic elements comprising a film support and at least one photosensitive layer containing a silver halide emulsion, the silver halide grains of which have been fogged through exposure or chemical treatment, so that the silver halide emulsion layer will produce direct positive images upon exposure and development.

BACKGROUND OF THE INVENTION

Direct positive films are used chiefly in reproduction technology because they enable the expert in the field to obtain a duplicate of the original rapidly without the necessity of producing intermediate photographs or intermediate negatives. Thus, for example, direct positive films are used for the production of transparent covers, clear intermediate copies, as well as duplicates of line and screen positives or negatives.

Photographic films have been produced which contain developer substances in the photographic film and which can be developed through simple treatment with a stable alkaline solution, the so-called "activator bath." The activation process can take place in table processors in very short times.

Since rapid processing is also desirable in the image reproduction industry, it would be desirable also to have available direct positive materials suitable for fast processing. It is generally known that the introduction of developer substances in photographic films presents considerable difficulty. For many applications, especially with transparent materials, density values of about 3 are necessary, so that highly active developers must be used.

In practice, the most frequently used high-activity superadditive developer combinations are hydroquinone/N-methyl-p-aminophenol sulfate and hydroquinone/1-phenyl-3-pyrazolidone. However, if these compounds are added to the photographic film, in general, photographic materials are obtained with an unsatisfactory stability on storage.

The difficulties are even more pronounced when developer substances are incorporated in direct positive emulsions, since a reciprocal influencing between silver fog and desensitizers occurs on the one hand and the developer on the other.

Thus, it is to be expected that the developer substance augments the fogging, in that development begins in the photographic film without activation, and as a result the later activation can no longer take place with sufficient differentiation, so that excessively high $D_{min}$ values are obtained. Beyond this, the material loses considerably in speed. Finally, developers and prefogged developer-containing direct positive materials can interact in such a way that a bleaching of the silver fog appears, so that in the activation only insufficient $D_{max}$ values are obtained, whereby in practice too high $D_{min}$ values appear at the same time. Moreover, the interaction between developer substances and desensitizers can lead to a decrease in speed by an order of magnitude compared to materials not containing developer. The interactions described are mostly time-dependent and, therefore, in practice lead to a negative effect on the storage stability.

From German Pat. No. 1,296,000 a process is already known for producing developer-containing direct positive materials, in which a colloidal layer containing a developer substance is applied to the dried direct positive emulsion layer, and whereby this layer must be dried within at most 50 seconds. Aside from the fact that this process requires special casting conditions, practice has shown that in the processing, a large part of the developer contained in the topcoat film does not diffuse to the silver halide grains but diffuses directly into the activator bath, so that a sufficient density value is not achieved.

Therefore, a direct positive material containing a developer substance is needed which in the activation gives direct positive images with good sensitometric values, that is, high $D_{max}$ values and low $D_{min}$ values. At the same time, the material must have good storage stability.

SUMMARY OF THE INVENTION

The above objects are achieved in accordance with the invention by a direct positive silver halide photographic element which, in the light-sensitive layer and/or in a gelatin-containing layer interposed between the light-sensitive layer and the film support, contains a developer combination comprising hydroquinone monosulfonate and a superadditive acting auxiliary developer compound of the 3-pyrazolidone or N-methyl-p-aminophenol sulfate type. These developer combinations of the invention are characterized by such a slow reactivity, that the chemically produced emulsion fog is not impaired in storage, so that the direct positive emulsion characteristic is completely retained. On the other hand, in the alkaline medium of the activator solution they reach their full developing power fast enough to obtain images with sufficient densities. Through this it is possible to produce direct positive images with high $D_{max}$ and low $D_{min}$ values using the activation process.

It is known that the storage stability of developer-containing photographic materials can be improved if they are used in combination with preservatives, usually sulfite ions. For example, if the combination hydroquinone/1-phenyl-3-pyrazolindone together with sulfite ions is incorporated, through reaction of the developer substances with sulfite a certain quantity of hydroquinone monosulfonate likewise forms. In spite of this, with activation, useful direct positive photographs are not obtained, but, rather, too low $D_{max}$ values and much too high $D_{min}$ values. Hence, the surprising effect of the invention is needed to produce a direct positive film with the desired properties.

DESCRIPTION OF THE PREFERRED EMBODIMENTS

3-Pyrazolidone compounds, such as those described in U.S. Pat. No. 2,751,297, have been found to be especially suitable as compounds acting superadditively. The best known compound is 1-phenyl-3-pyrazolidone. However, substituted compounds, such as the 4-methyl-, 4-ethyl-, 4-isopropyl-, 4,4-dimethyl-, 5-methyl-, 5,5-dimethyl-1-phenyl-3-pyrazolidones also display a superadditive action. A developer substance also displaying superadditive action is N-methyl-p-aminophenol sulfate.

The developer combinations of the invention can be added both to the light-sensitive layer itself, and also to a gelatin-containing intermediate layer arranged between the light-sensitive layer and the film support. To carry out the process, however, it has been found to be particularly advantageous to add the developer combination to a gelatin-containing intermediate layer arranged directly under and contiguous to the emulsion layer. Selectively, one developer substance can be in the auxiliary layer and the other in the light-sensitive emulsion layer.

The developer substances can be added to the photographic films in a quite wide range of concentrations. If the developer substances are added to the light-sensitive silver halide emulsion layer, then frequently a somewhat lower concentration is used than when the addition is made to an auxiliary layer.

Preferable concentrations for the hydroquinone monosulfonate developer are in the range of 1 to 3 g/m². The superadditively acting auxiliary developer substances preferably are used in quantities of 0.01 to 0.1 g/m². However, depending on the nature of the auxiliary developer substance, larger or smaller quantities also can be used.

Practically all of the fogged silver halide emulsions known for this purpose can be used as direct positive photographic silver halide emulsions. The fogging can be accomplished through the action of light or through the customary known fogging agents, such as stannous salts, hydrazine, sulfur compounds or water-soluble salts of gold, rhodium, platinum, palladium or iridium. Suitable direct positive fogged photographic silver halide emulsions are described in OLS (Offenlegungsschrift) Nos. 1,927,182, 2,104,161 and 2,229,926.

Activation of the developer-containing direct positive materials of the invention can be accomplished with the customary activator baths. As their main components, the activator baths contain a compound activating the developing process, usually a caustic alkali, and a preservative. Instead of caustic alkalies, sodium carbonate, potassium carbonate, aluminates, phosphates or organic bases can be used, whereas sodium sulfite usually serves as the preservative. Besides, other additives, such as stabilizers, development accelerators, wetting agents, etc. can be present.

Suitable activator baths preferably contain 40 to 60 g/l of alkali and 20 to 60 g/l of alkali sulfite. The activator solutions can be applied by various known methods to the exposed photographic material, for example, through immersing, spraying, etc. Preferably, however, the activation is accomplished by washing with rollers by means of a table processor. Following the activation process, the photographic material can be fixed and washed in the usual manner. If a longer storage stability is not required, a stabilizing bath can follow the activating bath. In this case, the washing process can be dispensed with.

The following examples will illustrate the invention in more detail:

EXAMPLE 1

To 1 liter solutions of 5% gelatin are added the following developer substances:

| | |
|---|---|
| Sample 1: | 30 g of hydroquinone monosulfonate<br>0.5 g of 1-phenyl-3-pyrazolidone |
| Sample 2: | 30 g of hydroquinone<br>0.5 g of 1-phenyl-3-pyrazolidone |

The gelatin solution is then applied to a polyethylene terephthalate film base so that a solid coating containing 3 g/m² of hydroquinone monosulfonate or hydroquinone and 0.05 g/m² of 1-phenyl-3-pyrazolidone results.

On this is applied a layer of a direct positive silver bromide emulsion which was produced in the presence of about $10^{-5}$ mols of rhodium (III) chloride and fogged chemically with $10^{-8}$ mols of cesium thiaborane and $10^{-5}$ mols of gold (III) chloride. The quantities thereby are based on 1 mol of silver halide. The silver halide coating amounts to 8 g/m² referred to silver nitrate.

Then, in the customary manner, a hardened gelatin protective film, which contains 1.5 g/m² of gelatin, is applied to the emulsion layer.

Then, the material, in the form of the known test strips, is exposed at a distance of 1 m with an iodine quartz lamp (1000 watts). Subsequently the two samples are activated for 30 seconds at 20° C. in an activator bath having the following composition:

| | | |
|---|---|---|
| NaOH | | 60.0 g |
| Sodium sulfite anh. | | 40.0 g |
| Potassium bromide | | 2.0 g |
| Benztriazole | | 0.1 g |
| Water | to | 1 liter |

The results obtained are compiled in the following table:

Table 1

| Number of sample | Freshly cast material | | Storage time of 5 days at 50° C. & 50% rel. humidity | |
|---|---|---|---|---|
| | $D_{max}$ | $D_{min}$ | $D_{max}$ | $D_{min}$ |
| Sample 1 | 3.98 | 0.08 | 3.95 | 0.10 |
| Sample 2 | 2.10 | 1.20 | 2.30 | 1.50 |

The sensitometric testing was carried out with freshly-coated material as well as with material that was aged for 5 days at 50° C. and 50% relative humidity. This aging corresponds approximately to a storage for 12 months under normal conditions.

From the above table, it is evident that with the developer combination of the invention direct positive images with very good sensitometric properties can be obtained using the activating method, whereas the combination of hydroquinone/1-phenyl-3-pyrazolidone reacts with the fogging of the emulsion so that no useful image reproduction is possible. At the same time, it is evident that the good sensitometric values also are completely retained with longer storage of the material.

EXAMPLE 2

A light-sensitive direct positive material is prepared according to the information in Example 1, with the single difference that the gelatin-containing intermediate layer of the individual samples contained the following developer substances:

| | |
|---|---|
| Sample 1: | 30 g of hydroquinone monosulfonate<br>0.5 g of 1-phenyl-3-pyrazolidone |
| Sample 2: | 30 g of hydroquinone<br>0.5 g of 1-phenyl-3-pyrazolidone |

-continued

| |
|---|
| 1.3 g of sodium sulfite anh. |

After drying, the material is activated for 30 seconds at 20° C. with the activator bath described in Example 1. Thereby the following results were obtained:

| Number of sample | Freshly cast material | | Storage time of 5 days at 50° C. & 50% rel. humidity | |
|---|---|---|---|---|
| | $D_{max}$ | $D_{min}$ | $D_{max}$ | $D_{min}$ |
| Sample 1 | 3.98 | 0.08 | 3.95 | 0.10 |
| Sample 2 | 2.30 | 1.50 | 2.40 | 1.70 |

From this example it is clearly evident that even with the combination hydroquinone/1-phenyl-3-pyrazolidone stabilized with sodium sulfite, an adequate direct positive image reproduction is not possible in the activation.

EXAMPLE 3

A direct positive emulsion was prepared according to the information in Example 1. The emulsion was divided into 2 portions and developer substances were added to the individual portions as follows:

| | |
|---|---|
| Sample 1: | 20 g of hydroquinone sulfonate<br>0.05 g of 1-phenyl-pyrazolidone |
| Sample 2: | 20 g of hydroquinone<br>0.05 g of 1-phenyl-pyrazolidone |

The two emulsions were cast according to the information in Example 1 and activated for 30 seconds at 20° C. with an activator bath having the following composition:

| | | |
|---|---|---|
| NaOH | | 40.0 g |
| Sodium sulfite anh. | | 20.0 g |
| Potassium bromide | | 2.0 g |
| Benztriazole | | 0.1 g |
| Water | to | 1 liter |

The following results were obtained:

| Number of sample | Freshly cast material | | Storage time of 5 days at 50° C. & 50% rel. humidity | |
|---|---|---|---|---|
| | $D_{max}$ | $D_{min}$ | $D_{max}$ | $D_{min}$ |
| Sample 1 | 2.80 | 0.05 | 2.60 | 0.10 |
| Sample 2 | 1.50 | 0.80 | 1.40 | 0.90 |

EXAMPLE 4

A light-sensitive direct positive material was prepared according to the information in Example 1, with the single difference that the gelatin-containing intermediate layer of the individual samples contained the following developer substances:

| | |
|---|---|
| Sample 1: | 30 g of hydroquinone sulfonate<br>0.3 of N-methyl-p-aminophenol sulfate |
| Sample 2: | 30 g of hydroquinone sulfonate |

-continued

| |
|---|
| 0.5 g of pyrocatechol |

The samples were then activated with an activator bath having the following composition for 30 seconds at 20° C.:

| | | |
|---|---|---|
| NaOH | | 60.0 g |
| Sodium sulfite anh. | | 40.0 g |
| Potassium bromide | | 2.0 g |
| Benztriazole | | 0.1 g |
| Water | to | 1 liter |

The results obtained are compiled in the following table:

| Number of sample | Freshly cast material | | Storage time of 5 days at 50° C. & 50% rel. humidity | |
|---|---|---|---|---|
| | $D_{max}$ | $D_{min}$ | $D_{max}$ | $D_{min}$ |
| Sample 1 | 3.20 | 0.08 | 3.05 | 0.15 |
| Sample 2 | 3.30 | 0.07 | 3.10 | 0.11 |

The substantial advantage of the present invention consists in that the developer combinations described have a sluggish reactivity such that during storage of the photographic material there is no interaction of any kind with the photographic emulsion or its components. Through this, the direct positive emulsion characteristic is fully retained. In spite of this extraordinary lack of reactivity, however, the developing process in the alkaline medium of the activator takes place without retardation immediately with unexpectedly high developing power. Consequently, the invention offers the expert in the field the possibility of producing direct positive images with good sensitometric values according to the activating process. An additional advantage is that the material described is characterized by a very good storage behavior.

What is claimed is:

1. A direct-positive silver halide photographic film comprising a film support, at least one photosensitive prefogged silver halide emulsion layer, a gelatin-containing layer interposed between said silver halide emulsion layer and the film support, and a developer combination comprising hydroquinone monosulfonate and a superadditively-acting auxiliary developer selected from the group consisting of N-methyl-p-aminophenol sulfate, 1-phenyl-3-pyrazolidone, 4-methyl-1-phenyl-3-pyrazolidone, 4-ethyl-1-phenyl-3-pyrazolidone, 4-isopropyl-1-phenyl-3-pyrazolidone, 4,4-dimethyl-1-phenyl-3-pyrazolidone, 5-methyl-1-phenyl-3-pyrazolidone, and 5,5-dimethyl-1-phenyl-3-pyrazolidone; at least one component of said developer combination being incorporated in said gelatin-containing layer.

2. The photographic film of claim 1 wherein the entire developer combination is incorporated into the gelatin-containing layer interposed between the silver halide emulsion layer and the film support.

3. The photographic film of claim 2 wherein the auxiliary developer is 1-phenyl-3-pyrazolidone.

4. The photographic film of claim 2 wherein the auxiliary developer is N-methyl-p-aminophenol sulfate.

5. The photographic film of claim 2 wherein the hydroquinone monosulfonate developer is present in an amount of from 1 to 3 g/m² and the auxiliary developer is present in an amount of 0.01 to 0.1 g/m².

6. The photographic film of claim 1 wherein one component of the developer combination is incorporated in the photosensitive silver halide emulsion layer, and the other component is incorporated in said gelatin-containing layer.

7. A direct-positive silver halide photographic film comprising a film support, at least one photosensitive prefogged silver halide emulsion layer, a gelatin-containing layer interposed between the photosensitive prefogged silver halide emulsion layer and the film support, and a developer combination comprising hydroquinone monosulfonate and a superadditively acting auxiliary developer selected from the group consisting of N-methyl-p-aminophenol sulfate, 1-phenyl-3-pyrazolidone, 4-methyl-1-phenyl-3-pyrazolidone, 4-ethyl-1-phenyl-3-pyrazolidone, 4-isopropyl-1-phenyl-3-pyrazolidone, 4,4-dimethyl-3-phenyl-3-pyrazolidone, 5-methyl-1-phenyl-3-pyrazolidone, and 5,5-dimethyl-1-phenyl-3-pyrazolidone; and wherein said developer combination is incorporated in the photosensitive prefogged silver halide emulsion layer.

* * * * *